US006610948B1

(12) United States Patent
Tsau

(10) Patent No.: US 6,610,948 B1
(45) Date of Patent: Aug. 26, 2003

(54) PUSHBUTTON OF KEYBOARD

(75) Inventor: Bruce Tsau, Taipei (TW)

(73) Assignee: Behavior Tech Computer Corporation, Taipei (TW)

( * ) Notice: Subject to any disclaimer, the term of this patent is extended or adjusted under 35 U.S.C. 154(b) by 0 days.

(21) Appl. No.: 10/072,957

(22) Filed: Feb. 12, 2002

(51) Int. Cl.[7] ..... H01H 13/70
(52) U.S. Cl. ..... 200/345; 200/54; 200/512
(58) Field of Search ..... 200/345, 341, 200/344; 400/490, 491, 491.2, 495, 495.1, 496

(56) References Cited

U.S. PATENT DOCUMENTS 5,283,408 A * 2/1994 Chen ..... 200/345
5,794,762 A * 8/1998 Tsai ..... 200/345
6,121,564 A * 9/2000 Huang ..... 200/345

* cited by examiner

*Primary Examiner*—Elvin Enad
*Assistant Examiner*—M. Fishman
(74) *Attorney, Agent, or Firm*—Rosenberg, Klein & Lee

(57) ABSTRACT

A keyboard pushbutton apparatus is provided. The apparatus includes a stationary base and a movable cap coupled in axially displaceable manner thereto. The base is formed with an upwardly, extending section within which are disposed at least a pair of wedge members. The cap is formed with a downwardly extending guide post that slidably engages the upwardly extending section of the base. The guide post includes at least a pair of opposed resiliently deflective panels, each formed with a pair of axially directed ribs protruding transversely therefrom. The ribs are laterally spaced to define therebetween a slot for slidably engaging one of the base wedge members. A lower portion of at least one of the ribs includes a transversely directed oblique face for engaging a first surface of the wedge member, and a laterally directed oblique face for engaging a second surfaces of the wedge member.

5 Claims, 3 Drawing Sheets

PUSHBUTTON OF KEYBOARD

FIELD OF THE INVENTION

The present invention generally relates to a computer keyboard, and in particular to a pushbutton structure of a computer keyboard.

BACKGROUND OF THE INVENTION

Pushbuttons of keyboards comprise a movable cap and a stationary base. The cap comprises a guide post depending therefrom. The base forms a hollow silo in which the guide post is movably received for guiding the movement of the cap with respect to the base. A normally open switching circuit is formed under the base whereby the movement of the cap toward the base close the switch to generate a signal indicating the actuation of the particular pushbutton. A resilient biasing member is provided below the guide post whereby when the pushbutton is depressed to close the normal open switch, the biasing member is deformed. When the pushbutton is released, the deformed biasing member springs back and forcibly drives the pushbutton back to its original position. To ensure smooth operation of the pushbutton, the contact area between the guide post and the guide silo must be large. However, such a large contact area cause high noise. Sophisticated structures are often employed to maintain smooth operation of the pushbutton. This increases costs of manufacturing.

It is thus desirable to have a pushbutton structure of keyboard for overcoming the above-mentioned problems.

SUMMARY OF THE INVENTION

Accordingly, an object of the present invention is to provide a keyboard pushbutton which cause substantially low noise during the operation thereof.

Another object of the present invention is to provide a keyboard pushbutton having a simple structure and low costs.

To achieve the above objects, in accordance with the present invention, there is provided a keyboard pushbutton comprising a stationary base forming an upward-extending silo having a rectangular cross section having four corners. Two wedge blocks are formed on an inside surface of the silo and are opposite to each other. A movable cap forms a depending guide post movably received in the silo whereby the cap is movable, with respect to the base between a released position and a depressed position. The guide post forms two panels each defining two slits for making the panel resiliently deflectable. Each panel forms a slot defined between two ribs for movably receiving the corresponding wedge block. The ribs converge toward each other at a free end of the panel and the converging configuration of the ribs is complementary to the shape of the wedge block for effectively preventing the cap from separating from the base and slowing down the moving speed of the cap when the cap is forcibly returned back from the depressed position to the released position so as to reduce the noise caused thereby. Each wedge block forms a camming surface and the corresponding ribs form inclined lower ends cooperating with the camming surface for guiding the wedge block into the slot between the ribs. The guide post forms flanges coextensive therewith, each flange having a rounded free edge in physical engagement with the corresponding corner of the silo for guiding smooth movement of the guide post with respect to the silo.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
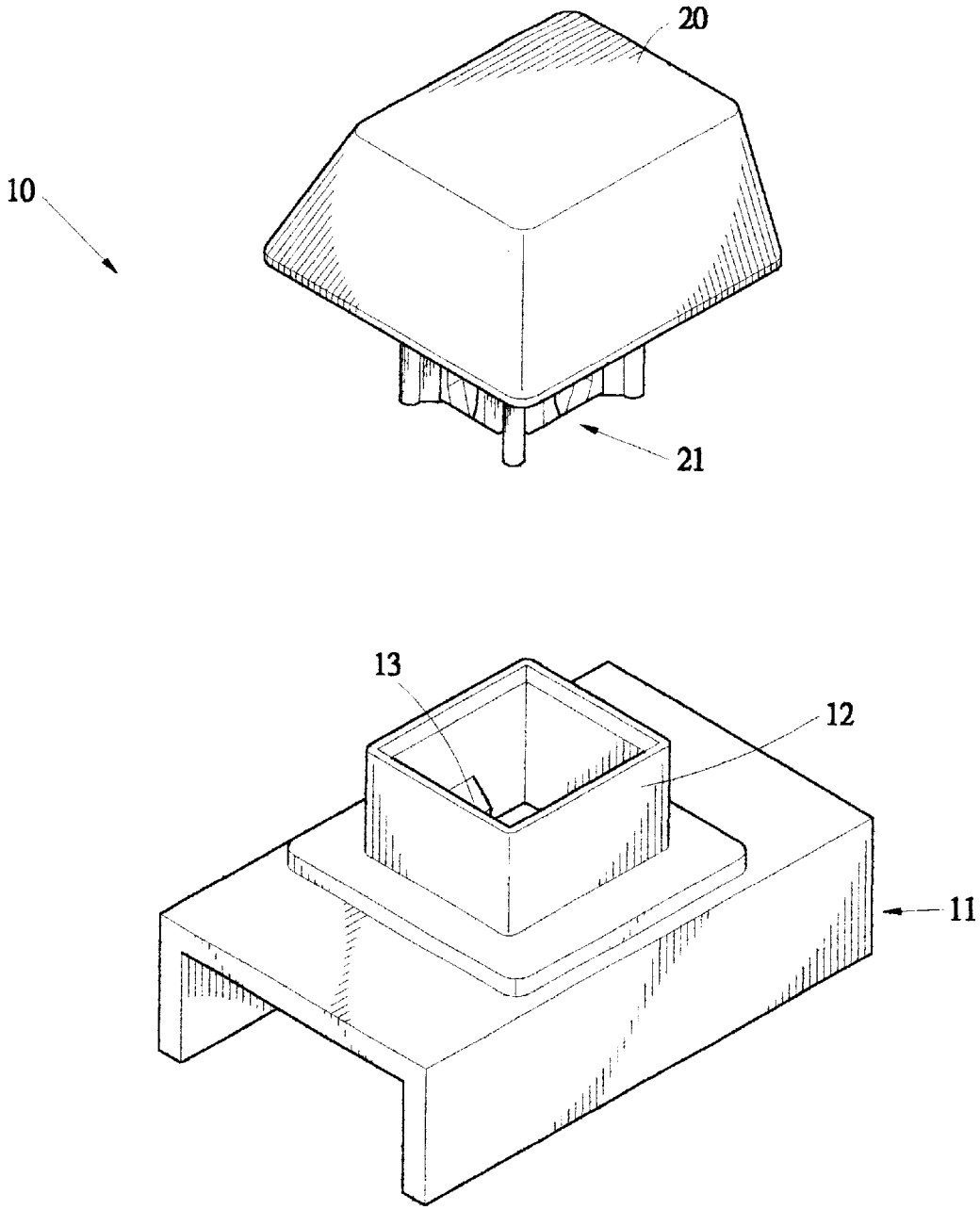
FIG. 1 is a perspective view of a keyboard pushbutton constructed in accordance with the present invention.
Figure 2:
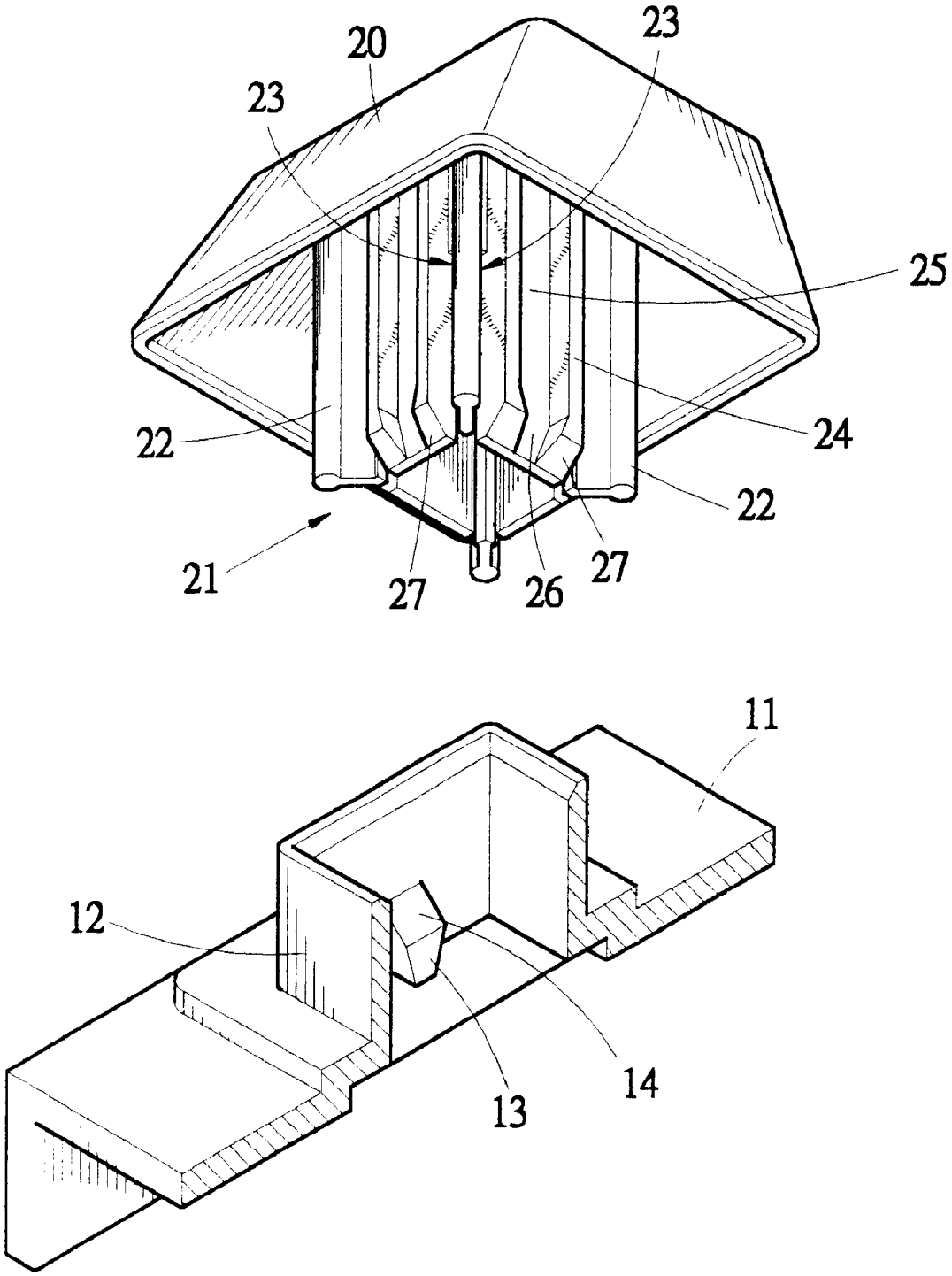
FIG. 2 is another perspective view of the keyboard pushbutton of the present invention with a portion thereof broken to show inside details.

With reference to the drawings and in particular to FIGS. 1 and 2, a keyboard pushbutton constructed in accordance with the present invention, generally designated with reference numeral 10, comprises a stationary base portion 11 and a movable cap 20 arranged above the base portion 11. The base portion 11 forms an upward-extending silo 12 which can be of any suitable shape. In the embodiment illustrated, the silo 12 has a rectangular or square cross section. The cap 20 forms a depending guide post 21 on a bottom thereof. The post 21 is movably received in the silo 12 whereby the cap 20 is movable with respect to the base portion 11 between a released position and a depressed position. A normally open switching circuit (not shown) is formed below the base portion 11 whereby when the cap 20 is moved to the depressed position, a remote end of the guide post 21 actuates and thus closes the normally open switching circuit to generate a signal indicating the actuation of the pushbutton 10.

In the embodiment illustrated, the guide post 21 is integrally formed with the cap 20. The guide post 21 has a substantially rectangular cross section having four side walls and four corners (both not labeled), each corner forming a diagonally-extending flange 22 coextensive with the guide post 21. The flanges 22 are arranged to be substantially symmetric in the embodiment illustrated. Each flange 22 has a rounded free edge physically engageable with a corresponding corner of the silo 12 of the base portion 11 for guiding smooth movement of the cap 20 with respect to the base portion 11.

Figure 3:
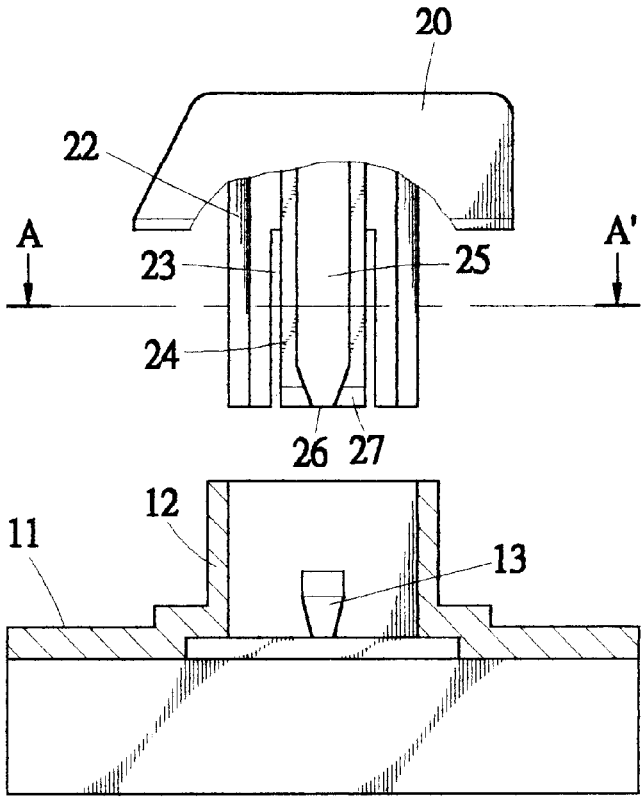
FIG. 3 is a cross-sectional view of the keyboard pushbutton of the present invention.
Figure 4:
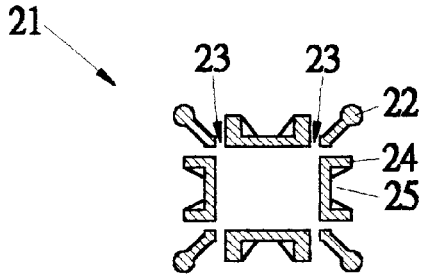
FIG. 4 is a cross-sectional view taken along line A—A of FIG. 3.

Also referring to FIGS. 3 and 4, two slits 23 are defined in each of two opposite side walls of the guide post 21. The slits 23 extend from a lower free end of the side wall and along a portion of the side wall so as to form a resiliently deflectable panel 24. A slot 25 is defined in an outer surface of the panel 24 by two opposite ribs (not labeled). The ribs converge toward each other at the lower free end of the side wall to form a reduced opening 26 at the lower free end of the side wall.

A wedge block 13 is formed on an inner surface of a side wall (not labeled) of the silo 12 and is movably received in each slot 25 of the guide post 21. The wedge block 13 is configured to be substantially complementary to the reduced opening 26 of the slot 25 so as to effectively prevent the cap 20 from detaching from the silo 12. Since the blocks 13 are made wedge-shaped, physical engagement between the blocks 13 and the ribs of the slot 25 is reduced which lowers down the noise caused thereby.

In addition, each wedge block 13 is provided with an inclined camming surface 14. Lower ends of the ribs of each slot 25 are also made inclined as designated by reference numeral 27. The inclined ends 27 of the ribs of the slot 25 cooperate with the camming surface of the wedge block 13, with the aid of the resiliency of the panel 24, to facilitate forcing the wedge block 13 into the slot 25.

The wedge blocks 13 are movably received in the corresponding slots 25 of the panels 24 and guide the movement of the cap 20 with respect to the base portion 11. When the cap 20 of the pushbutton 10 is manually actuated/depressed and moved toward the depressed position, the normally open switching circuit is closed to generate a signal indicating the actuation of the pushbutton 10. A resilient biasing member, which is not shown in the drawings but is known to those having ordinary skills in the art, is positioned below the guide post 21 whereby when the cap 20 is moved toward the depressed position, the resilient biasing member is resiliently deformed. When the pushbutton 10 is released, the resilient biasing member that is resiliently deformed springs back to its original shape and forcibly drives the cap 20 back to the released position. The movement of the cap 20 is guided by the wedge blocks 13 received in the slots 25. The converging configuration of the ribs of the slots 25, as well as the wedge blocks 13, helps slowing down the speed of the cap 20 in returning back to the released position. This smoothens the operation of the pushbutton 10 and reduces the noise caused by the movement of the cap 20 with respect to the base portion 11.

In addition, since the guide post 21 is integrally formed with the cap 20 and since the wedge blocks 13 are integrally formed with the silo 12, there is not separate parts. The manufacturing process is thus simplified and costs are reduced. Furthermore, the reduced number of parts also helps in reducing noise caused by the operation of the pushbutton 10.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A keyboard pushbutton apparatus comprising:

(a) a stationary base having an upwardly extending section, said upwardly extending section having formed therein at least a pair of wedge members, said wedge member having a first surface and at least one second surface; and, (b) a movable cap coupled in axially displaceable manner to said base, said cap having a downwardly extending guide post slidably engaging said upwardly extending section of said base, said guide post including at least a pair of opposed resiliently deflective panels, each of said panels having a pair of axially directed ribs protruding transversely therefrom, said ribs being laterally spaced to define therebetween a slot for slidably engaging one said wedge member of said base, a lower portion of at least one of said ribs including a transversely directed oblique face for engaging said first surface of said wedge member, and a laterally directed oblique face for engaging one said second surface of said wedge member.

2. The keyboard pushbutton apparatus as recited in claim 1 wherein said first surface of said wedge member is inclined for camming engagement of said transversely directed oblique face of at least one said rib of said panel to guide said wedge member and said panel slot into said slidable engagement one with the other.

3. The keyboard pushbutton apparatus as recited in claim 2 wherein each said panel is at least partially defined between a pair of longitudinal slits formed into said guide post.

4. The keyboard pushbutton apparatus as recited in claim 2 wherein said upwardly extending section of said base is formed with a polygonal sectional contour defining a plurality of longitudinally extending corners, said base coaxially receiving said guide post of said cap therein.

5. The keyboard pushbutton apparatus as recited in claim 4 wherein said guide post includes a plurality of flanges extending longitudinally there along, each said flange having a rounded outer contour for slidably engaging one said corner defined within said upwardly extending section of said base.

* * * * *